US006199792B1

(12) United States Patent
Mivelaz

(10) Patent No.: US 6,199,792 B1
(45) Date of Patent: Mar. 13, 2001

(54) DEVICE AND MODULE FOR FEEDING WEB-LIKE MATERIAL

(75) Inventor: Dominique Mivelaz, Echallens (CH)

(73) Assignee: Bobst S.A., Lausanne (CH)

( * ) Notice: Subject to any disclaimer, the term of this patent is extended or adjusted under 35 U.S.C. 154(b) by 0 days.

(21) Appl. No.: 09/232,788

(22) Filed: Jan. 19, 1999

(30) Foreign Application Priority Data

Jan. 20, 1998 (CH) ..... 0119/98

(51) Int. Cl.[7] ..... B65H 16/02; B65H 16/10
(52) U.S. Cl. ..... 242/564; 242/594.4
(58) Field of Search ..... 242/564, 594.3, 242/594.4, 599, 599.2, 530.3

(56) References Cited

U.S. PATENT DOCUMENTS

| | | | | |
|---|---|---|---|---|
| 2,890,002 | * | 6/1959 | Thomas | 242/594.3 |
| 3,391,876 | * | 7/1968 | Dalglish | 242/530.3 |
| 3,627,217 | * | 12/1971 | Baker | 242/594.3 |
| 4,012,001 | * | 3/1977 | Knox | 242/564 |
| 4,116,401 | | 9/1978 | Evert . | |
| 5,490,639 | * | 2/1996 | Droutsas | 242/530.3 |

FOREIGN PATENT DOCUMENTS

| | | |
|---|---|---|
| 37 15179 A1 | 11/1988 | (DE) . |
| 0 313 859 A2 | 9/1988 | (EP) . |
| 1 551 085 | 10/1967 | (FR) . |
| 2 284 199 | 5/1995 | (GB) . |
| WO 96/37427 A2 | 11/1996 | (WO) . |

* cited by examiner

*Primary Examiner*—John M. Jillions
(74) *Attorney, Agent, or Firm*—Allen N. Friedman; McCarter & English, LLP

(57) ABSTRACT

This web feeding device comprises at least one spindle (11, 12, 13) pivotally mounted in a frame (14), each spindle connected to a pair of drive motors and longitudinally divided into two sections (11*a*, 11*b*; 12*a*, 12*b*; 13*a*, 13*b*) that are mounted so as to rotate independently of one another. Two drive mechanisms (8, 25; 9, 26; 10, 27) for these two sections (11*a*, 11*b*; 12*a*, 12*b*; 13*a*, 13*b*) are connected at the same end of the spindle (11, 12, 13). The section (11*a*, 12*a*, 13*a*) adjacent to this end is in the form of a tubular element pivotally mounted on an axial shaft (4, 5, 6). The tubular element is connected to one drive mechanism (25, 26, 27), and the end of the shaft (4, 5, 6) adjacent to the common end of the spindle (11, 12, 13) is connected to the other drive mechanism (8, 9, 10), whereas the other end of the shaft (4, 5, 6 ) is secured to the second section (11*b*, 12*b*, 13*b*) of the spindle.

4 Claims, 3 Drawing Sheets

DEVICE AND MODULE FOR FEEDING WEB-LIKE MATERIAL

RELATED APPLICATIONS

This application claims priority from Swiss Patent Application Switzerland No.1998 0119/98, filed Jan. 20, 1998.

GOVERNMENT FUNDED RESEARCH

Not Applicable

BACKGROUND OF THE INVENTION

1. Field of the Invention

The present invention relates to a device for feeding a web-like material, the device comprising a spindle pivotally mounted on a frame and connected to a driving motor. This invention also relates to a feeding module comprising at least two such feeding devices.

2. Brief Description of the Background Art

In certain fields one must feed a manufacturing process with different web-like materials at feed rates that may be substantially different for the different materials, each feed rate depending on the quantity of web-like material used. Consequently, in order to supply only the necessary lengths to the manufacturing process, so as to optimize the use of the web-like materials, the spindles must be driven at different speeds and/or for different periods. This problem occurs particularly when manufacturing sheet-like materials having a surface that is selectively metalized by means of bonded metal sheets. This is a commonly used method for printing and embossing paper or cardboard sheets for manufacturing packages, particularly packages for luxury goods.

It is obviously possible to place each roll of web-like material on an independent spindle, driven by its own motor, but the multiplicity of these spindles produces a space requirement problem. Furthermore, in order to permit selective distribution of the web-like material at the required place on the blanks of paper or cardboard, the spindles for feeding the web-like materials must extend across the whole working width of the machine. However, the width of the web-like materials is almost always substantially smaller than the working width of the machine itself, which approximately corresponds to the width of the paper or cardboard sheets. Therefore, usually only a small part of the length of a web-feeding spindle is used. Alternatively, if a number of web-like material rolls are arranged side by side on the same spindle, the quantity of web-like material fed by this spindle must be adjusted to feed all materials according to the web-like material with greatest usage. This increases the waste of the other web-like materials placed on this same spindle. The aim of the present invention is to meet, at least partly, the difficulties of the above-mentioned solutions.

SUMMARY OF THE INVENTION

In order to address the above problems, this invention is directed to a device for feeding web-like material, in which the web-feeding spindle is divided into two separate sections, mounted so as to be rotationally independent of one another. This device comprises two independent drive mechanisms for these two sections, both connected at the same end of the spindle. The section of the spindle adjacent to this end is in the form of a tubular element pivotally mounted on a shaft extending axially through this tubular element. This tubular element is connected to one of the pair of drive mechanisms. The end of the axial shaft at this same end of the spindle comprises means for connecting it to the other drive mechanism, whereas the other end of the shaft is connected to the second section.

Obviously, a plurality of these devices can be placed side by side on the same machine, thus constituting a feeding module according to the maximum number of different webs to be fed by a given machine. Each such device is able to distribute two different webs at independent speeds and/or time intervals. In such a module, devices with respective spindles having sections with lengths that vary from one spindle to the other can be advantageously placed, in order to permit placement of webs with different widths, in different positions with respect to the working width of the machine.

Thus, this device not only allows the continuous or intermittent driving of coaxial spindles at different intervals and/or speeds, but also allows variation of the length of the different sections, thus providing great flexibility with regard to placement of the different material webs.

Further features and advantages of this invention will become evident from the reading of the following description and from the enclosed drawings illustrating, schematically and by way of example, an embodiment of this motorized device for driving spindles.

DETAILED DESCRIPTION OF THE INVENTION

Figure 1:
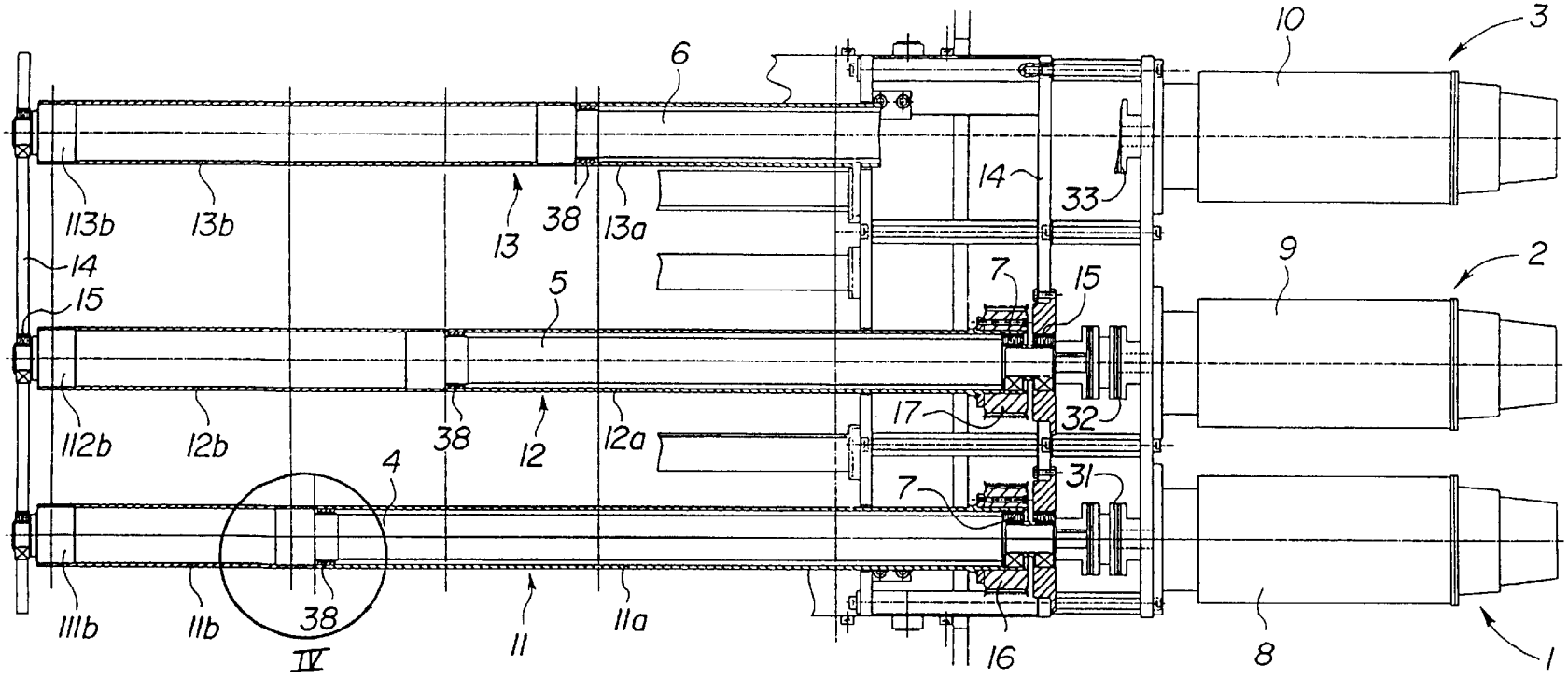
FIG. 1 is a partially sectional top view of a machine comprising three motor driven devices according to the invention.
Figure 2:
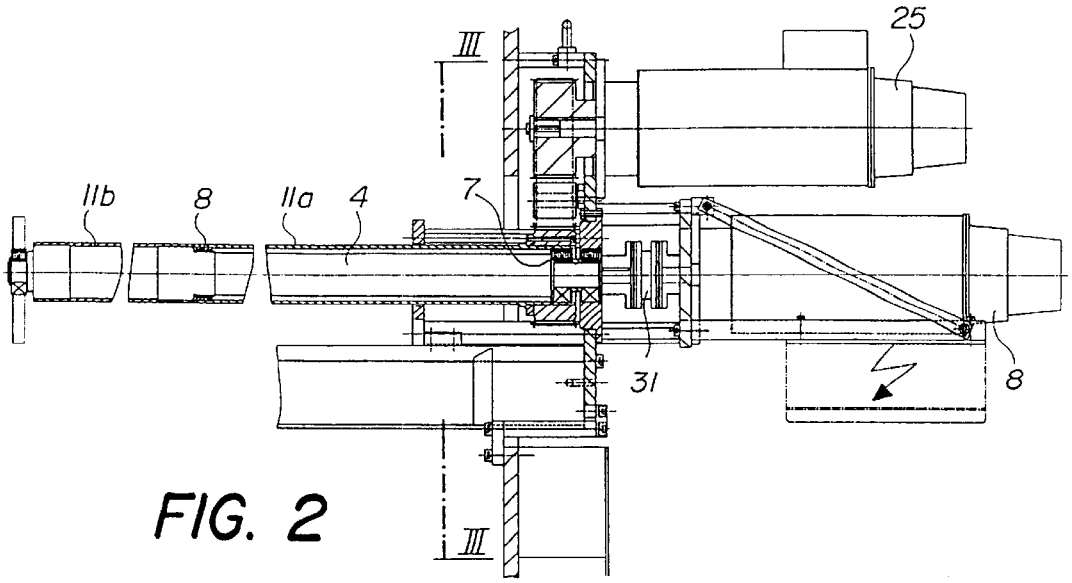
FIG. 2 is a partially sectional front view of the device depicted in FIG. 1.

FIG. 1 shows a module for feeding web-like material such as can be used in a machine for printing patterns on paper, cardboard or substrates of metallized plastic by means of bonded metallic sheets, particularly for printing in the field of packaging.

Figure 4:
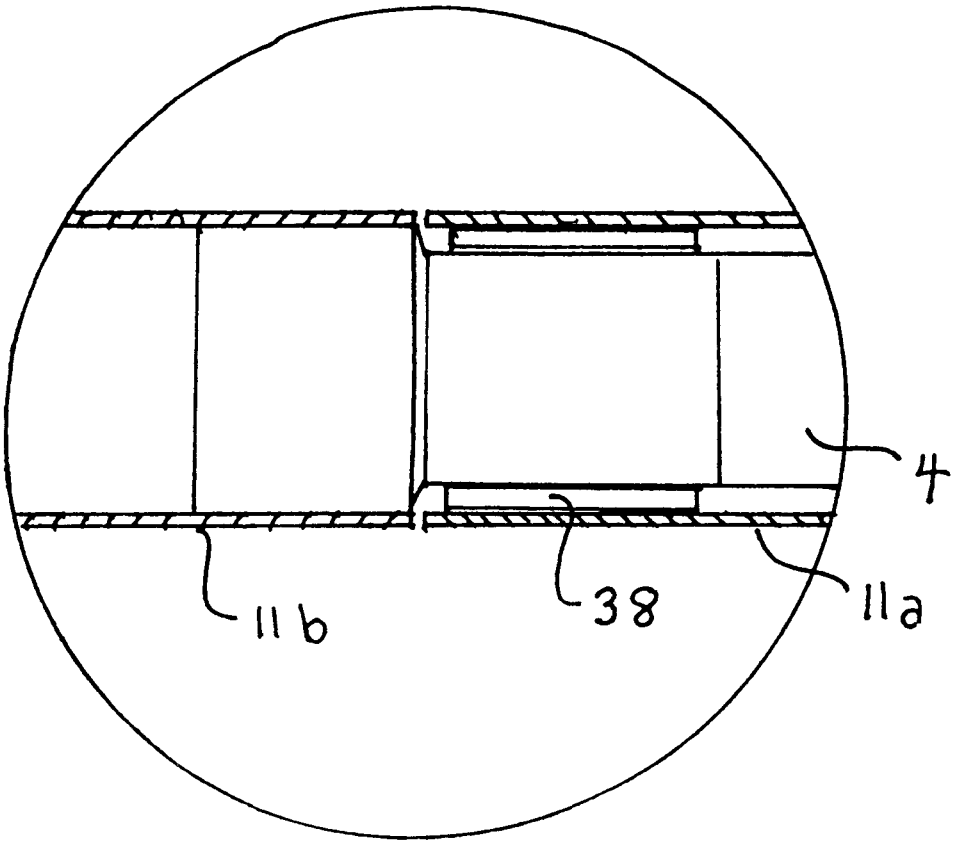
FIG. 4 is an expanded detail of FIG. 1, as indicated by the circle IV.

In the illustrated example, the feeding module comprises three feeding devices 1, 2, 3 mounted on a frame 14 comprising members supporting either end of the feeding devices, as illustrated in FIG. 1. Each device includes a spindle 11, 12, 13, longitudinally divided into two sections 11*a*, 11*b*; 12*a*, 12*b*; 13*a*, 13*b*, The first sections 11*a*, 12*a*, 13*a* consist essentially of tubular elements rotatably mounted on shafts 4, 5,6 by means, for example, of ball bearings 7 placed at one end and needle bearings 38 placed at the other end. FIG. 4 shows an expanded detail of the rotatable mounting of section 11*a* on shaft 4 by means of needle bearings 38. Tubular element 11*b* is fixed to shaft 4.

One end of each shaft 4, 5, 6 is connected to a drive motor 8, 9, 10, for example, by a flexible coupling system 31, 32, 33. Whereas the respective opposite ends of these shafts 4, 5, 6 are secured to the second sections 11*b*, 12*b*, 13*b* of the spindles 11, 12, 13.

As can be seen from the drawing, these second sections 11*b*, 12*b*, 13*b* also each consist essentially of tubular elements, one end of which is fixed in one end of the respective shafts 4, 5, 6. A pivoting arrangement 111*b*, 112*b*, 113*b* is fixed to the other end of these same spindles 11, 12, 13. The pivoting members 111*b*, 112*b* and 113*b* are pivoted in their respective bearings 15.

As can be seen in FIG. 1, the three spindles 11, 12, 13 are of equal length, but are divided into sections 11*a*, 11*b*, 12*a*, 12*b*; 13*a*, 13*b*, the respective lengths of the sections varying from one spindle to the other. This length variation between the corresponding sections of the different spindles 11, 12, 13 is intended to provide feeding spindles having different lengths in each of the two halves of the length of each of the feeding devices 1, 2, 3 of the feeding module. By means of this arrangement, the user can position different lengths of spindle sections 11*a*, 12*a*, 13*a* and respectively 11*b*, 12*b*, 13*b* for each half of the length of the feeding module, permitting the user to mount web-like material rolls having different widths on these sections. This dimensional variability provides the user a choice corresponding to the particular need.

Figure 3:
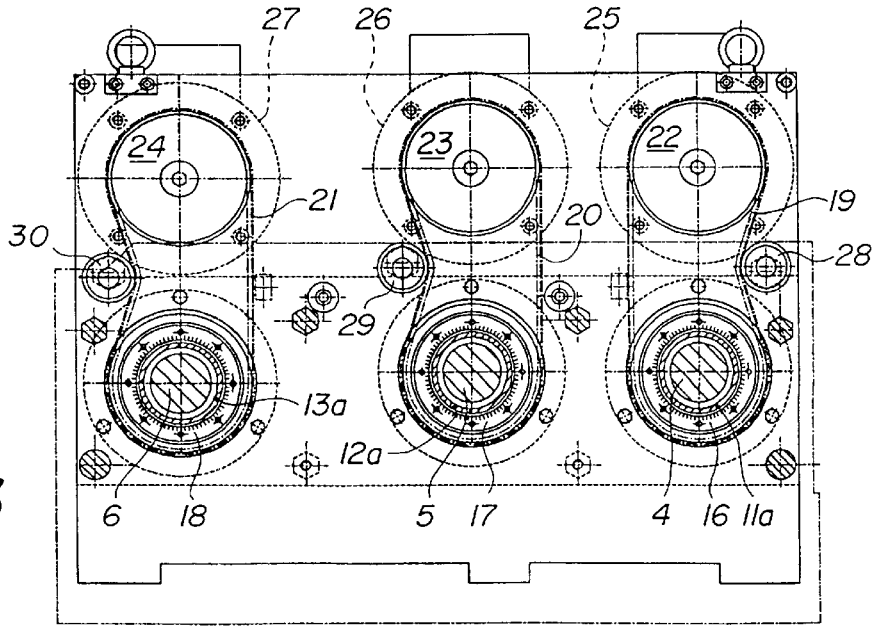
FIG. 3 is a sectional view according to line III—III of FIG. 2.

The sections 11*b*, 12*b*, 13*b* are driven by the shafts 4, 5, 6 engaging the driving motors 8, 9, 10, whereas the sections 11*a*, 12*a*, 13*a* are secured to toothed pinion gears 16, 17, 18. As illustrated in FIG. 3, each of these gears, 16, 17 and 18 is connected by a toothed belt 19, 20, 21 to a toothed gear 22, 23, 24 mounted on the output shaft of a drive motor 25, 26, 27. Pressure rollers 28, 29, 30 are used to apply an appropriate tension to the belts 19, 20, 21.

Since each of the two sections 11*a*, 11*b*; 12*a*, 12*b*; 13*a*, 13*b* of the spindles 11, 12, 13 is driven by an independent motor, each of these sections can be driven at intervals, during periods and at speeds, independent of another section by appropriate programming of the driving motors 8, 9, 10, 25, 26, 27, whether this section belongs to the same spindle or to another spindle. The programming of these driving motors is not a part of the present invention and is not necessary to its understanding, so that it will not be described here.

It is to be understood that the described feeding module can include a different number of spindles than three, depending on the particular application. However, in the case of a feeding module for a machine used for printing metallized imprints on sheets or blanks of paper or cardboard, more particularly with respect to manufacturing packages from these sheets or blanks, the described exemplary module covers most practical combinations.

What is claimed is:

1. A device for feeding web-like material comprising at least one spindle (11, 12, 13) pivotally mounted in a frame (14), each spindle connected to a first drive motor (8, 9, 10) and a second drive motor (25, 26, 27), wherein each said spindle (11, 12, 13) is divided in its length into two separate sections (11*a*, 11*b*; 12*a*, 12*b*; 13*a*, 13*b*) mounted so as to be rotationally independent of one another, wherein the two respective drive motors (8, 25; 9, 26; 10, 27) for each of said two sections (11*a*, 11*b*; 12*a*, 12*b*; 13*a*, 13*b*) is connected at a first end of each said spindle (11, 12, 13), the section (11*a*, 12*a*, 13*a*) adjacent to this first end comprising a tubular element pivotally mounted on a shaft (4, 5, 6) extending axially therethrough and this tubular element being secured to means (16 through 24) for connecting it to the second drive motor (25, 26, 27), a first end of said shaft (4, 5, 6) adjacent to said first end of said spindle (11, 12, 13) comprising means (31, 32, 33) for connecting it to the first drive motor (8, 9, 10), whereas a second end of said shaft (4, 5, 6) is secured to said second section (11*b*, 12*b*, 13*b*) the first drive motor being driven independently of the second drive motor, the first and second drive motors being driven in the unwinding direction.

2. A device of claim 1, wherein the first end of the shaft (4, 5, 6) adjacent to the first end of the spindle (11, 12, 13) is pivotally mounted in the frame (14), whereas the spindle's (11, 12, 13) second end is pivotally mounted in the frame (14) by means of securing the free end of the second section (11*b*, 12*b*, 13*b*) to the shaft (4, 5, 6).

3. A feeding module for feeding a web-like material comprising at least two spindles (11, 12, 13) pivotally mounted in a frame (14), each spindle connected to a first drive motor (8, 9, 10) and a second drive motor (25, 26, 27), wherein each said spindle (11, 12, 13) is divided in its length into two separate sections (11*a*, 11*b*; 12*a*, 12*b*; 13*a*, 13*b*) mounted so as to be rotationally independent of one another, wherein the two respective drive motors (8, 25; 9, 26; 10, 27) for each of said two sections ( 11*a*, 11*b*; 12*a*, 12*b*; 13*a*, 13*b*) is connected at a first end of each said spindle (11, 12, 13), the section (11*a*, 12*a*, 13*a*) adjacent to this first end comprising a tubular element pivotally mounted on a shaft (4, 5, 6) extending axially therethrough and this tubular element being secured to means (16 through 24) for connecting it to the second drive motor (25, 26, 27), a first end of said shaft (4, 5, 6) adjacent to said first end of said spindle (11, 12, 13) comprising means (31, 32, 33) for connecting it to the first drive motor (8, 9, 10), whereas a second end of said shaft (4, 5, 6) is secured to said second section (11*b*, 12*b*, 13*b*), the first drive motor being adapted to be driven independently of the second drive motor, whereby each section of each spindle ( 11*a*, 11*b*; 12*a*, 12*b*; 13*a*, 13*b*) is driven at different speeds in the unwinding direction and for different periods in response to appropriate programming of the drive motors (8, 25; 9, 26; 10, 27).

4. A feeding module of claim 3 wherein corresponding sections (11*a*, 12*a*, 13*a*; 11*b*, 12*b*, 13*b*) of each of the spindles (11, 12, 13) have different lengths.

* * * * *